US005850864A

United States Patent [19]

Decker

[11] Patent Number: 5,850,864

[45] Date of Patent: Dec. 22, 1998

[54] INSULATED SEALING WINDOW SHADE

[76] Inventor: Brian C. Decker, 7 Broadway, New York, N.Y. 10004

[21] Appl. No.: 840,094

[22] Filed: Apr. 14, 1997

Related U.S. Application Data

[63] Continuation-in-part of Ser. No. 654,071, May 28, 1996, abandoned.

[51] Int. Cl.[6] ..... A47G 5/02

[52] U.S. Cl. ..... 160/268.1; 160/368.1

[58] Field of Search ..... 160/268.1, 368.1, 160/238, 370.22, 349.1, 349.2

[56] References Cited

U.S. PATENT DOCUMENTS 1,306,127 6/1919 Sharps et al. ..... 160/903 X
4,079,772 3/1978 Klaenhammer et al. .
4,397,346 8/1983 Chumbley et al. .
4,419,982 12/1983 Eckels .
4,426,816 1/1984 Dean et al. .
4,436,137 3/1984 Charles .
4,510,986 4/1985 Schwankl .
4,972,896 11/1990 Roberts .

*Primary Examiner*—Blair M. Johnson

[57] ABSTRACT

An insulated sealing window shade including a non-transparent insulated shade portion fixedly secured to a cylindrical tube. The cylindrical tube has end portions thereof secured to mounting brackets secured above a window. The mounting brackets each have a pin extending inwardly therefrom with the shade portion positioned between the pins and the window. The shade portion is biased around the cylindrical tube. Various applications are used for sealing the insulated shade portion around a window to prevent light and limiting sound from permeating through the window.

1 Claim, 5 Drawing Sheets

FIG 9
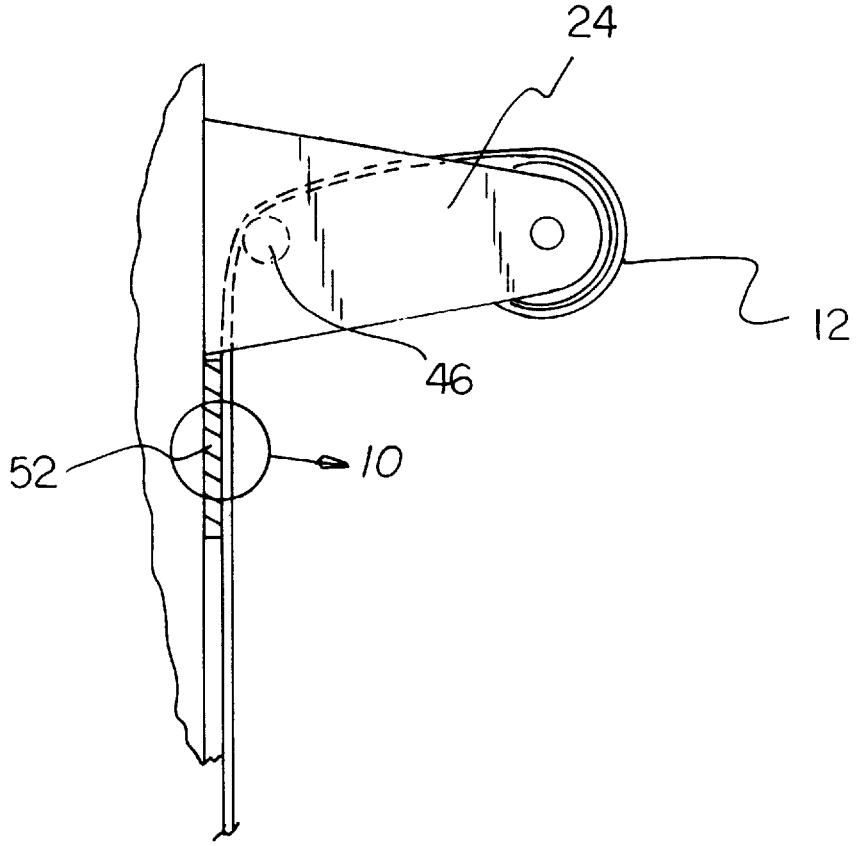
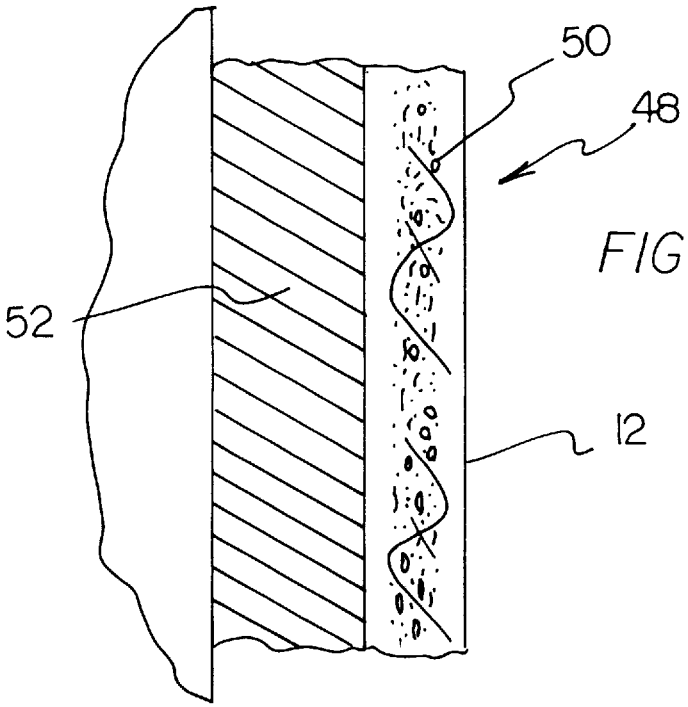
FIG 10

INSULATED SEALING WINDOW SHADE

This application is a continuation-in-part of application Ser. No. 654,071 filed May 28, 1996 abandoned.

BACKGROUND OF THE INVENTION

1. Field of the Invention

The present invention relates to an insulated sealing window shade and more particularly pertains to preventing light and sound from entering through a window with an insulated sealing window shade.

2. Description of the Prior Art

The use of window shades is known in the prior art. More specifically, window shades heretofore devised and utilized for the purpose of sealing windows are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,079,772 to Klaenhammer et al. discloses a window shade sealing system. U.S. Pat. No. 4,397,346 to Chumbley et al. discloses an insulated window shade. U.S. Pat. No. Des. 320,127 to Schopp discloses the ornamental design for a window shade or similar article. U.S. Pat. No. 5,400,848 to Gainer discloses decorative shades. U.S. Pat. No. 4,398,585 to Marlow discloses a thermally efficient window shade construction. U.S. Pat. No. 4,102,383 to Miller discloses a window shade.

While these devices fulfill their respective, particular objective and requirements, the aforementioned patents do not describe an insulated sealing window shade for preventing light and sound from entering through a window.

In this respect, the insulated sealing window shade according to the present invention substantially departs from the conventional concepts and designs of the prior art, and in doing so provides an apparatus primarily developed for the purpose of preventing light and sound from entering through a window.

Therefore, it can be appreciated that there exists a continuing need for new and improved insulated sealing window shade which can be used for preventing light and sound from entering through a window. In this regard, the present invention substantially fulfills this need.

SUMMARY OF THE INVENTION

In the view of the foregoing disadvantages inherent in the known types of window shades now present in the prior art, the present invention provides an improved insulated sealing window shade. As such, the general purpose of the present invention, which will be described subsequently in greater detail, is to provide a new and improved insulated sealing window shade and method which has all the advantages of the prior art and none of the disadvantages.

To attain this, the present invention essentially comprises an insulated shade portion comprised of an interior layer and an exterior layer. The insulated shade portion has an upper edge, a lower edge, and a pair of side edges together defining a periphery of the insulated shade portion. The upper edge is fixedly secured to a cylindrical tube. The cylindrical tube has end portions thereof secured to mounting brackets secured above a window. The shade portion is biased around the cylindrical tube. The device includes a plurality of flexible magnetic strips. One magnetic strip is secured along the lower edges of the insulated shade portion on the interior layer thereof. A magnetic strip is secured along each of the pair of side edges of the insulated shade portion on the interior layer thereof. Corresponding magnetic strips are secured along side edges and a lower edge of the window whereby the plurality of flexible magnetic strips of the interior layer of the insulated shade portion can be coupled to the corresponding magnetic strips of the window when the insulated shade portion is in an extended orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is another object of the present invention to provide a new and improved insulated sealing window shade which may be easily and efficiently manufactured and marketed.

It is a further object of the present invention to provide a new and improved insulated sealing window shade which is of durable and reliable construction.

An even further object of the present invention is to provide a new and improved insulated sealing window shade which is susceptible of a low cost of manufacture with regard to both materials and labor, and which accordingly is then susceptible of low prices of sale to the consuming public, thereby making such an insulated sealing window shade economically available to the buying public.

Still yet another object of the present invention is to provide a new and improved insulated sealing window shade which provides in the apparatuses and methods of the prior art some of the advantages thereof, while simultaneously overcoming some of the disadvantages normally associated therewith.

Even still another object of the present invention is to provide a new and improved insulated sealing window shade for preventing light and sound from entering through a window.

Lastly, it is an object of the present invention to provide a new and improved insulated sealing window shade including a non-transparent insulated shade portion fixedly secured to a cylindrical tube. The cylindrical tube has end portions thereof secured to mounting brackets secured above a window. The mounting brackets each have a pin extending inwardly therefrom with the shade portion positioned between the pins and the window. The shade portion is biased around the cylindrical tube. Various applications are used for sealing the insulated shade portion around a window to prevent light and limiting sound from permeating through the window.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a side view as taken along line 9—9 of FIG. 8.

FIG. 10 is an enlarged side view of the magnetic coupling as taken from circle 10 of FIG. 9.

The same reference numerals refer to the same parts through the various Figures.

DESCRIPTION OF THE PREFERRED EMBODIMENT

Figure 1:
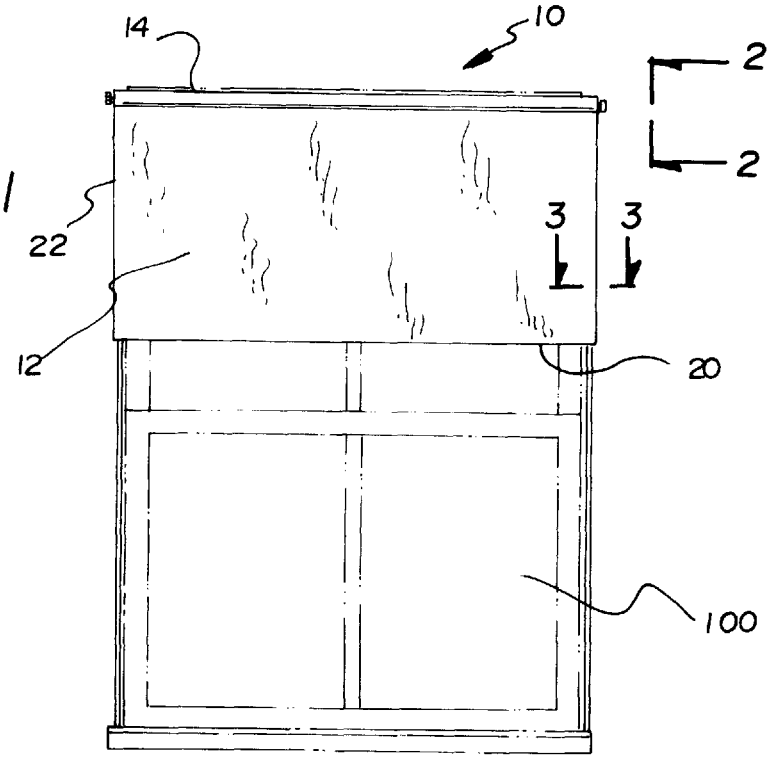
FIG. 1 is a front view of the preferred embodiment of the insulated sealing window shade constructed in accordance with the principles of the present invention.
Figure 2:
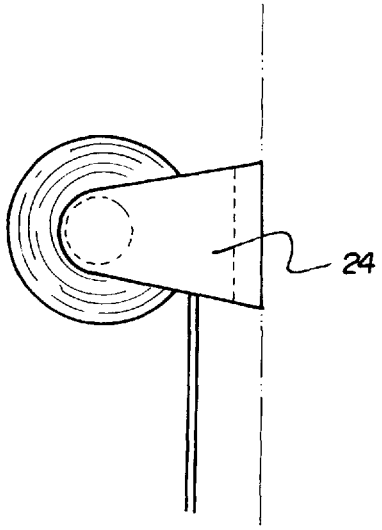
FIG. 2 is a side view of the present invention taken along line 2—2 of FIG. 1.
Figure 3:
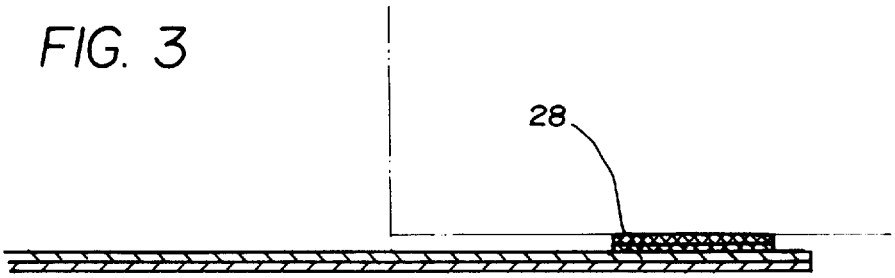
FIG. 3 is a cross-sectional view as taken along line 3—3 of FIG. 1.

With reference now to the drawings, and in particular, to FIGS. 1 through 10 thereof, the preferred embodiment of the new and improved insulated sealing window shade embodying the principles and concepts of the present invention and generally designated by the reference number 10 will be described.

Specifically, it will be noted in the various Figures that the device relates to an insulated sealing window shade for preventing light and sound from entering through a window. In its broadest context, the device consists of an insulated shade portion and a non-transparent insulated shade portion and a plurality of flexible magnetic strips. Such components are individually configured and correlated with respect to each other so as to attain the desired objective.

The device 10 includes a non-transparent insulated shade portion 12 comprised of an interior layer 14 and an exterior layer 16. The interior layer 14 and the exterior layer 16 are of equal thickness. The insulated shade portion 12 has an upper edge 18, a lower edge 20, and a pair of side edges 22 together defining a periphery of the insulated shade portion 12. The upper edge 18 is fixedly secured to a cylindrical tube. The cylindrical tube has end portions thereof secured to mounting brackets 24 secured above a window 100. The shade portion 12 is biased around the cylindrical tube. The device 10 operates in a similar fashion as standard roll-up shades whereby a person grasps the lower edge 20 of the shade portion 12 and pulls downwardly to fully, or partially, extend the shade portion 12. Pulling slightly downward on the lower edge 20 will allow the shade portion 12 to retract onto the cylindrical tube in a closed orientation above the window 100.

The device 10 also includes a plurality of flexible magnetic strips 28. One magnetic strip 28 is secured along the lower edge 20 of the insulated shade portion 12 on the interior layer 14 thereof. A magnetic strip 28 is secured along each of the pair of side edges 22 of the insulated shade portion 12 on the interior layer 14 thereof. Corresponding magnetic strips 28 are secured along side edges and a lower edge of the window 100 whereby the plurality of flexible magnetic strips 28 of the interior layer 14 of the insulated shade portion 12 can be coupled to the corresponding magnetic strips 28 of the window 100 when the insulated shade portion 12 is in an extended orientation. This will serve to block any light from coming through the window 100. The insulated shade portion 12 will also aid in drowning out sounds permeating through the window.

Figure 4:
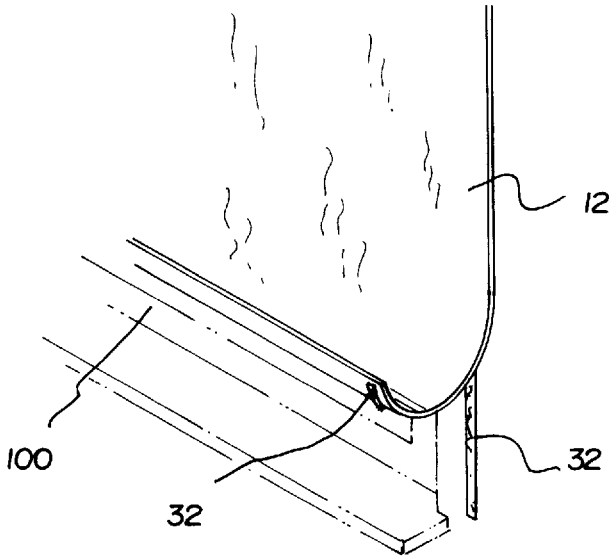
FIG. 4 is a partial perspective view of a second embodiment of the present invention.

A second embodiment of the present invention is shown in FIG. 4 and includes substantially all of the components of the present invention wherein the means for sealing the insulated shade portion 12 around the window 100 further comprises pile fastener strips 32 disposed along peripheral edges of the insulated shade portion 12. Corresponding pile fastener strips 32 are disposed along the upper edge, side edges and a lower edge of the window 100 whereby the pile fastener strips 32 of the insulated shade portion 12 are coupleable to the corresponding pile fastener strips 32 of the window 100 when the insulated shade portion 12 is in an extended orientation.

Figure 5:
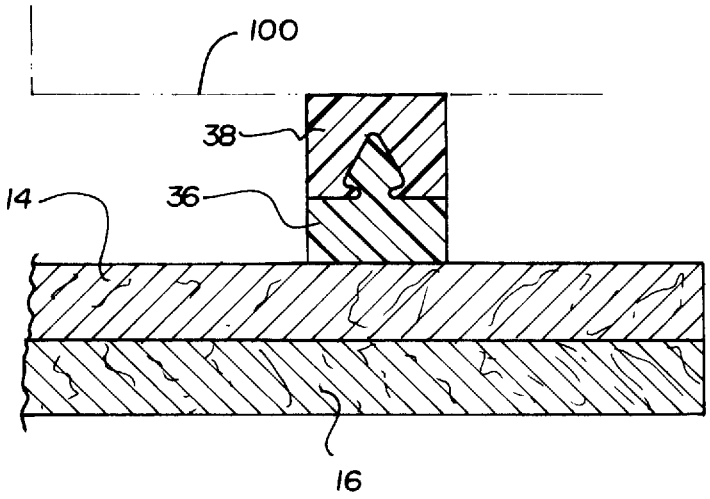
FIG. 5 is a cross-sectional view of a third embodiment of the present invention.

A third embodiment of the present invention is shown in FIG. 5 and includes substantially all of the components of the present invention wherein the means for sealing the insulated shade portion 12 around the window 100 further comprising male zip lock strips 36 disposed along peripheral edges of the insulated shade portion 12. Corresponding female zip lock strips 38 are disposed along the upper edge, side edges and the lower edge of the window 100 whereby the male zip lock strips 36 of the insulated shade portion 12 are coupleable to the corresponding female zip lock strips 38 of the window 100 when the insulated shade portion 12 is in an extended orientation.

Figure 6:
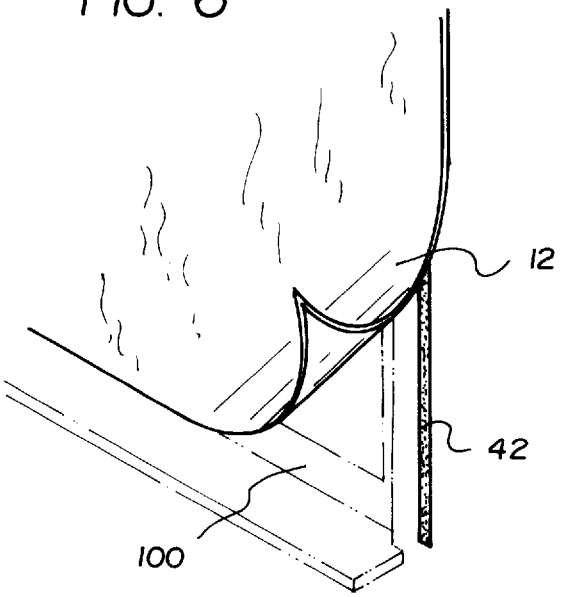
FIG. 6 is a partial perspective view of a fourth embodiment of the present invention.
Figure 7:
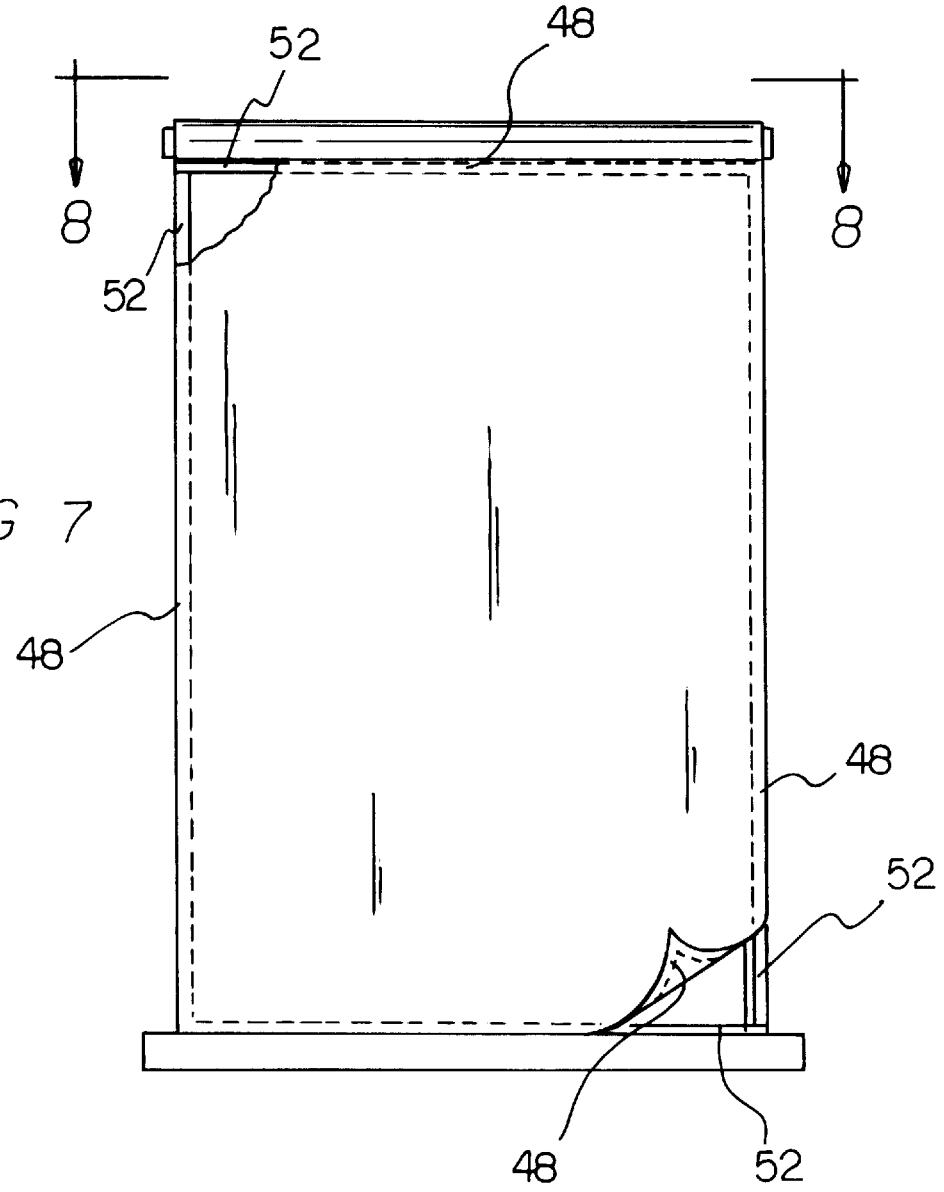
FIG. 7 is a front view of a fifth embodiment of the present invention.
Figure 8:
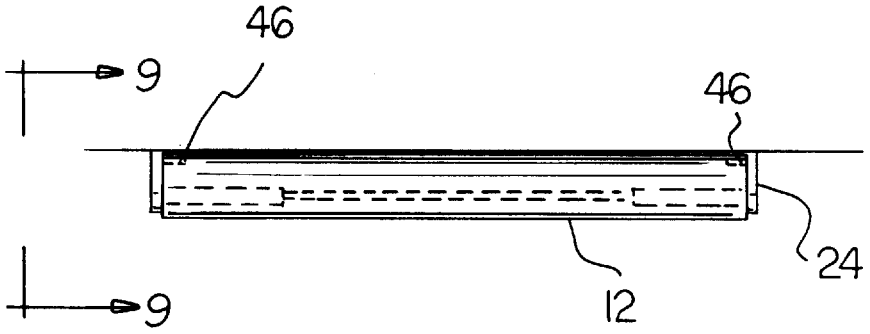
FIG. 8 is a top plan view as taken along line 8—8 of FIG. 7.

A fourth embodiment of the present invention is shown in FIG. 6 and includes substantially all of the components of the present invention wherein the means for sealing the insulated shade portion 12 around the window 100 further comprising resealable tape strips 42 disposed along the upper edge, side edges and the lower edge of the window 100 whereby the resealable strips 42 engaging peripheral edges of the insulated shade portion 12 when the insulated shade portion 12 is in an extended orientation.

A fifth embodiment of the present invention is shown in FIGS. 7–10 and includes substantially all of the components of the present invention wherein the mounting brackets each have a pin 46 extending inwardly therefrom with the shade portion 12 positioned between the pins 46 and the window 100. A magnetically responsive material 48 is disposed around the periphery of the interior layer of the shade portion 12. The magnetically responsive material 48 is comprised of iron particles 50 formed within the periphery of the shade. Note FIGS. 9 and 10. Alternately four metal strips could be used. One metal strip for the upper edge, the two side edges and the lower edge of the shade portion. A plurality of flexible magnetic strips 52 secured along an upper edge, side edges and a lower edge of the window 100 whereby the magnetically responsive material 48 of the interior layer of the insulated shade portion 12 is coupleable to the plurality of magnetic strips 52 of the window 100 when the insulated shade portion 12 is in an extended orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An insulated sealing window shade for preventing light and sound from entering through a window comprising, in combination:

a non-transparent insulated shade portion comprised of an interior layer and an exterior layer, the insulated shade portion having an upper edge, a lower edge, and a pair of side edges together defining a periphery of the insulated shade portion, the upper edge being fixedly secured to a cylindrical tube, the cylindrical tube having end portions thereof secured to mounting brackets secured above a window, the mounting brackets each having a pin extending inwardly therefrom with the shade portion positioned between the pins and the window with the shade portion resting on the pins, the shade portion adapted to being situated around the cylindrical tube;

a magnetically responsive material disposed on the periphery of the shade portion, said periphery including the side edges, the bottom edge, and an area adjacent said upper edge between said side edges, the magnetically responsive material comprising metal particles formed within the periphery of the shade; and a plurality of flexible magnetic strips secured along an upper edge, side edges and a lower edge of a window whereby the magnetically responsive material of the interior layer of the insulated shade portion is coupleable to the plurality of magnetic strips of the window when the insulated shade portion is in an extended orientation.

* * * * *